US005387152A

United States Patent [19]

Packer et al.

[11] Patent Number: 5,387,152

[45] Date of Patent: Feb. 7, 1995

[54] COIN DEPOSIT APPARATUS

[76] Inventors: Ervin E. Packer; Beverly A. Diener-Packer, both of 404 Dogwood Ave., Brighton, Colo. 80601

[21] Appl. No.: 99,526

[22] Filed: Jul. 30, 1993

[51] Int. Cl.[6] ..... G07D 1/00

[52] U.S. Cl. ..... 453/52; 453/63

[58] Field of Search ..... 453/48–54, 453/63; 194/343; 221/267, 279

[56] References Cited

U.S. PATENT DOCUMENTS

| | | | |
|---|---|---|---|
| 497,059 | 5/1893 | Ramey | 453/49 |
| 1,011,272 | 12/1911 | Teeter et al. | 453/48 |
| 2,443,862 | 6/1948 | Justus | 221/279 |
| 4,462,414 | 7/1984 | Gordon | 453/44 |
| 4,874,348 | 10/1989 | Lafreniere et al. | 453/50 |
| 4,884,992 | 12/1989 | Grimes | 453/29 |

*Primary Examiner*—F. J. Bartuska

*Attorney, Agent, or Firm*—E. Michael Combs

[57] ABSTRACT

A coin deposit apparatus arranged for mounting onto a coin receiving plate of a slot machine includes a housing, having a semi-cylindrical lower magazine arranged to accommodate a row of coins thereon, with a semi-cylindrical lid mounted upon the coins to enclose the coins, with the lid projecting beyond a forward end of the lower magazine for mounting upon the coin receiving plate of the slot machine. A piston cooperates with a trigger member to project the piston into engagement with the coins and direct the coins forwardly through spaced springs for projection into the coin receiving plate.

6 Claims, 4 Drawing Sheets

COIN DEPOSIT APPARATUS

BACKGROUND OF THE INVENTION

1. Field of the Invention

The field of invention relates to coin feeding devices, and more particularly pertains to a new and improved coin deposit apparatus wherein the same is arranged to sequentially feed coins into a slot machine.

2. Description of the Prior Art

Devices for directing coins into a slot machine is indicated in U.S. Pat. No. 4,462,414 wherein a structure is mounted onto the coin receiving plate, having a slide bar arranged to permit coins one at a time to be directed into the coin receiving plate.

Other examples of coin dispensing structure is indicated in U.S. Pat. Nos. 4,884,992 and 4,874,348.

The instant invention attempts to overcome deficiencies of the prior art by providing for a gun-like mechanism arranged to cooperate with a slot machine to direct coins in a one-at-a-time basis thereto and in this respect, the present invention substantially fulfills this need.

SUMMARY OF THE INVENTION

In view of the foregoing disadvantages inherent in the known types of coin feed apparatus now present in the prior art, the present invention provides a coin deposit apparatus wherein the same is directed for mounting upon a coin receiving plate to direct coins thereto in a sequential manner. As such, the general purpose of the present invention, which will be described subsequently in greater detail, is to provide a new and improved coin deposit apparatus which has all the advantages of the prior art coin deposit apparatus and none of the disadvantages.

To attain this, the present invention provides a coin deposit apparatus arranged for mounting onto a coin receiving plate of a slot machine, including a housing having a semi-cylindrical lower magazine arranged to accommodate a row of coins thereon, with a semi-cylindrical lid mounted upon the coins to enclose the coins, with the lid projecting beyond a forward end of the lower magazine for mounting upon the coin receiving plate of the slot machine. A piston cooperates with a trigger member to project the piston into engagement with the coins and direct the coins forwardly through spaced springs for projection into the coin receiving plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved coin deposit apparatus which has all the advantages of the prior art coin deposit apparatus and none of the disadvantages.

It is another object of the present invention to provide a new and improved coin deposit apparatus which may be easily and efficiently manufactured and marketed.

It is a further object of the present invention to provide a new and improved coin deposit apparatus which is of a durable and reliable construction.

An even further object of the present invention is to provide a new and improved coin deposit apparatus which is susceptible of a low cost of manufacture with regard to both materials and labor, and which accordingly is then susceptible of low prices of sale to the consuming public, thereby making such coin deposit apparatus economically available to the buying public.

Still yet another object of the present invention is to provide a new and improved coin deposit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
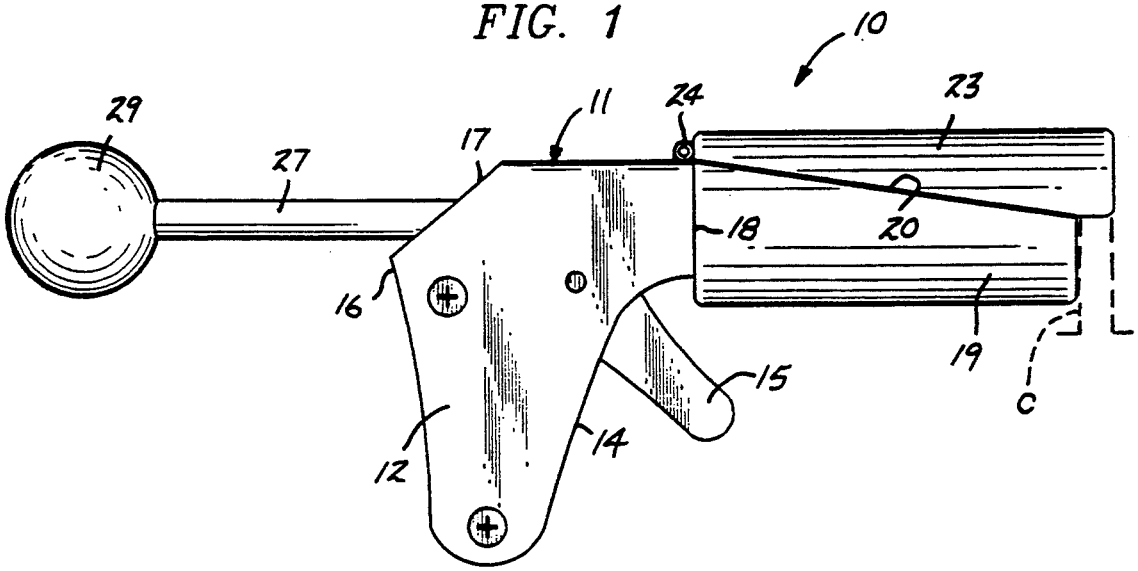
FIG. 1 is an orthographic side view of the invention.
Figure 2:
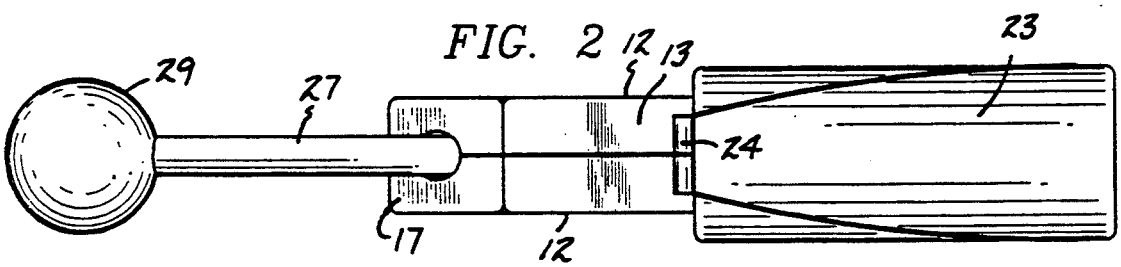
FIG. 2 is an orthographic top view of the invention.
Figure 3:
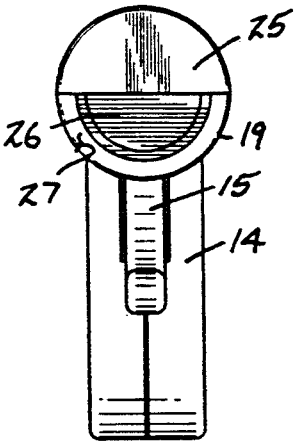
FIG. 3 is an orthographic frontal view of the invention.

With reference now to the drawings, and in particular to FIGS. 1 to 10 thereof, a new and improved coin deposit apparatus embodying the principles and concepts of the present invention and generally designated by the reference numeral 10 will be described.

More specifically, the coin deposit apparatus 10 of the instant invention essentially comprises a housing 11, having housing side walls 12 arranged in a spaced relationship, with a housing top wall 13, a housing rear wall 16, and a housing forward wall 14. An upper rear wall 17 extends from the rear wall 16 to the top wall 13 receiving a piston rod 27 slidably therethrough. A housing guide tube 18 extends between the front wall 14 and the top wall 13 (see FIG. 4) coastally aligned with the piston rod 27 and an associated central axis 21. A semi-cylindrical lower magazine 19 is secured about the guide tube 18 symmetrically oriented relative to the axis 21, having a canted side wall 20 extending from the top wall 13 to the central axis 21. A semi-cylindrical lid 23 is provided pivotally mounted about a spring hinge 24 that in turn is secured to the top wall 13 adjacent the rearward end of the lower magazine 19. The lid 23 is complementarily received onto the canted side walls 20 (see FIG. 2) and extends symmetrically about the axis 21 and projects beyond the lower magazine forward opening 22. A lid forward flange 25 is mounted to the forwardmost ends of the lid 23, with the lid forward flange 25 orthogonally oriented relative to the axis 21 when the lid is in contiguous communication with the canted side walls 20. In this manner, spacing of the lid forward flange 25 relative to the lower magazine forward opening 22 permits reception of the coin receiving plate "C" between the forward opening 22 and the lid forward flange 25.

Figure 4:
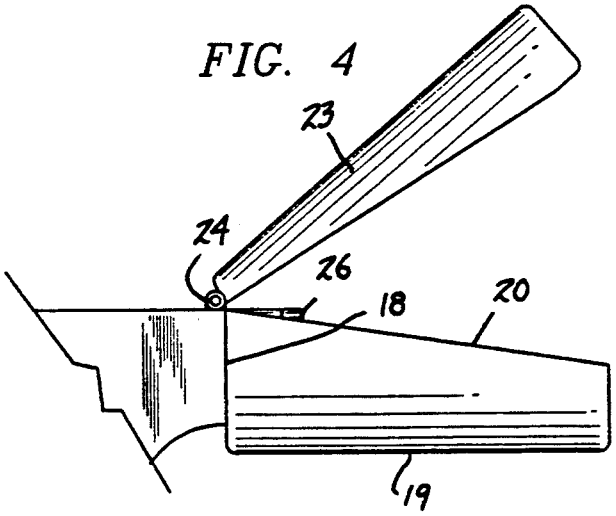
FIG. 4 is an orthographic view of the magazine and the lid raised therefrom.
Figure 5:
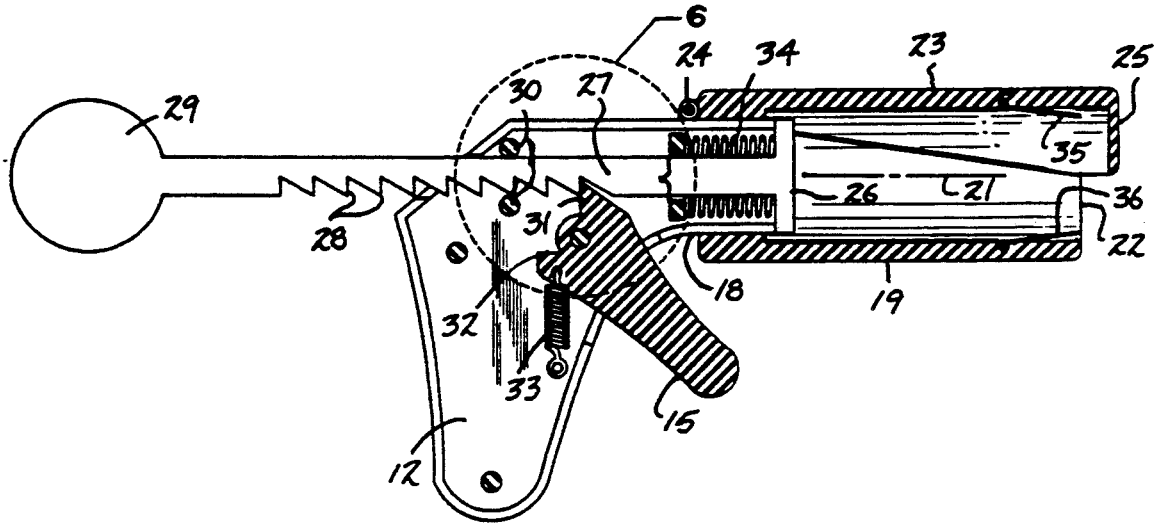
FIG. 5 is an orthographic cross-sectional illustration of the mechanism.
Figure 6:
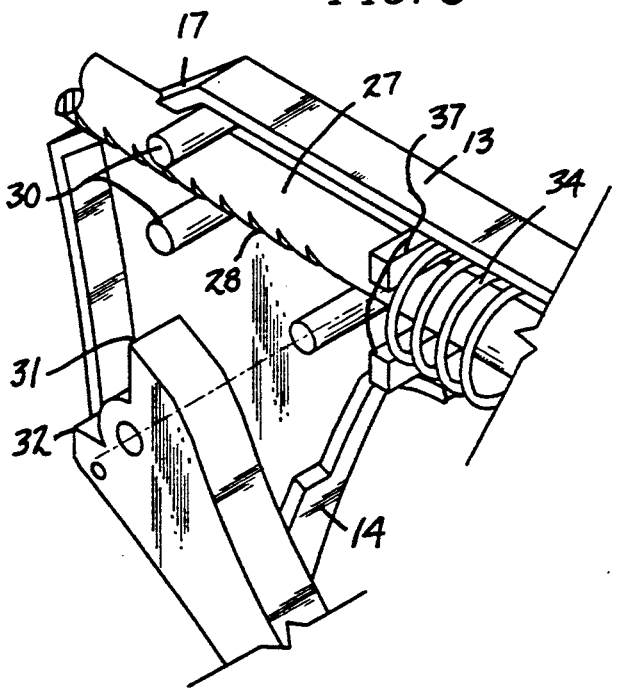
FIG. 6 is an isometric illustration of section 6 as set forth in FIG. 5.

A piston plate 26 is slidably mounted along the lower magazine 19 orthogonally oriented relative to the axis 21 fixedly mounted to a forwardmost end of the piston rod 27. A row of ratchet teeth 2g are directed into the rod 27 in a facing relationship relative to a first and second projection 31 and 32 respectively of an associated trigger lever 15 that is pivotally mounted within the housing 11 and time trigger lever 15 projecting through the forward wall 14, as illustrated in FIG. 4. A handle 29 mounted to the rod 27 at a rearward distal end thereof permits ease of displacement of the piston plate 26 from the housing 11. Spaced guide pins 30 oriented fixedly and orthogonally between the side walls 12 guide the rod 27 in adjacency to the top wall 13 and the upper rear wall 17. Second guide pins 37 mounted within the guide tube further guide the piston rod therethrough, with a piston spring 33 interposed between the piston plate 26 and the second guide pins 37. As illustrated, a trigger return spring 33 is fixedly secured within the housing at one end of the trigger return spring, with the second end of the trigger return spring secured to the trigger 15 to bias the trigger 15 in a raised orientation in adjacency to the lower magazine tube 19, whereupon rotation of the trigger lever 15 about its axle within the housing 11 effects forward displacement of the piston rod and the piston plate 26 against the row of coins mounted within the lower magazine 19. The coins are forced through first and second guide spring plates 35 and 36 mounted in a diametrical relationship relative to one another within the lid 23 and the lower magazine 19 respectively to provide for coins on a one-at-a-time basis to be directed between the spring plates 35 and 36 against the lid forward flange 25 permitting their reception within the coin receiving plate "C". The piston spring 35 is of sufficient strength to merely maintain the piston plate in communication against the coins (not shown) interposed between the first and second guide spring plates 35 and 36 and the piston plate 26 within the lower magazine tube 19 and in an enclosed orientation when the lid 23 is in contiguous communication with the canted side walls 20.

Figure 7:
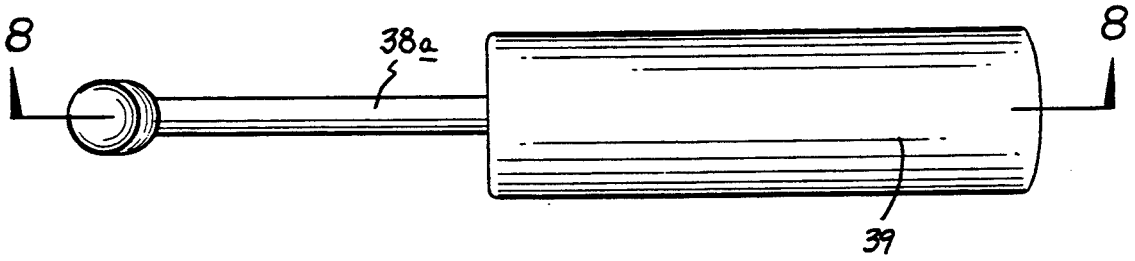
FIG. 7 is an orthographic top view of a coin charging tube for filling the magazine of the apparatus.
Figure 8:
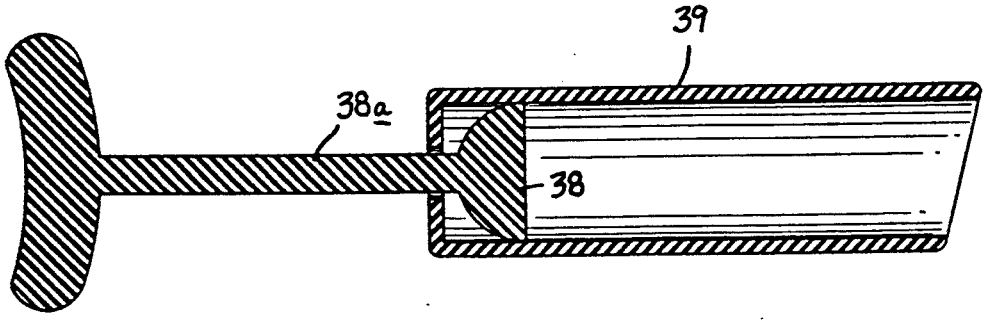
FIG. 8 is an orthographic view, taken along the lines 8—8 of FIG. 7 in the direction indicated by the arrows.
Figure 9:
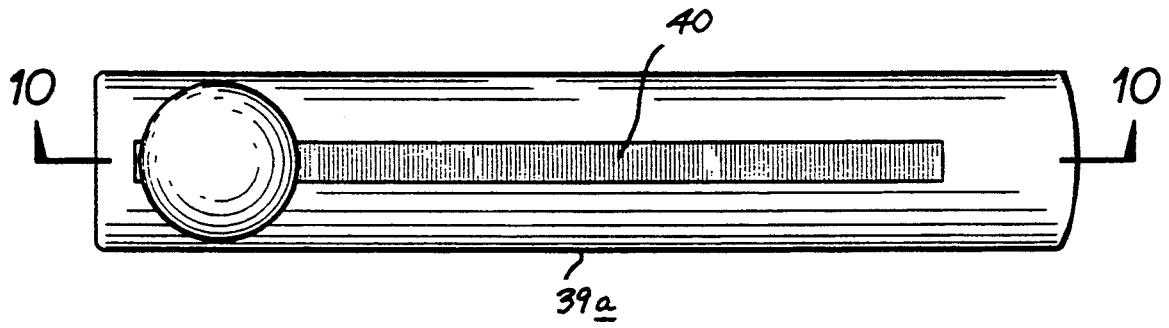
FIG. 9 is an orthographic top view of a modified coin charging tube.
Figure 10:
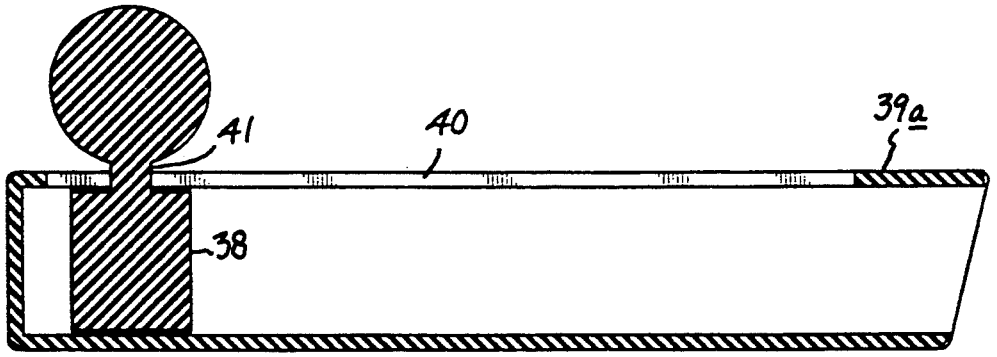
FIG. 10 is an orthographic view, taken along the lines 10—10 of FIG. 9 in the direction indicated by the arrows.

The FIGS. 7 and 8 indicate the use of a magazine charger tube 39 permitting reception of a row of coins therewithin for the subsequent positioning and projection onto the lower magazine 19. The magazine charger tube 39 includes a tube piston 38 therewithin mounted to a piston rod 38*a* to permit selective displacement of the coins positioned within the magazine charger tube 39. The modified charger tube 39*a*, as illustrated in FIGS. 9 and 10, merely indicates that the tube piston 38 is formed with a guide rod 41 directed through a guide slot 40 through a side wall of the charger tube 39*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A coin deposit apparatus, comprising, a housing, with the housing including spaced side walls, a top wall, a forward wall, and a rear wall, with an upper rear wall extending from the rear wall to the top wall, and a guide tube integral with the housing extending intermediate the top wall and the forward wall, with the guide tube symmetrically oriented about a predetermined axis, a piston rod coaxially aligned with the axis slidably received through the upper rear wall, having a handle mounted at a rearwardmost distal end of the piston rod, and a forwardmost end of the piston rod including a piston plate orthogonally oriented relative to the axis, and a semi-cylindrical lower magazine tube mounted to the guide tube coaxially aligned with the axis, with the piston plate slidably received within the lower magazine, and a lid having a lid hinge, with the lid hinge mounted to the top wall in adjacency to the lower magazine, with the lid having a semi-cylindrical configuration arranged for contiguous communication with lower magazine side walls when the lid is in a first position in contiguous communication with the lower magazine side walls, with the lid arranged for pivoting about the lid hinge when the lid is raised relative to the lower magazine, and the lid including a lid forward flange spaced from the lower magazine in the first position permitting reception of a coin receiving plate between the lid forward flange and the lower magazine, with the piston plate arranged to direct coins within the lower magazine beyond the lower magazine.

2. An apparatus as set forth in claim 1 wherein the lower magazine side walls are canted from the housing top wall and extend to the axis.

3. An apparatus as set forth in claim 3 wherein the lower magazine includes a lower magazine forward opening in a facing relationship relative to the lid forward flange when the lid is in the first position, with a first spring plate mounted to the lid extending over the lower magazine forward opening, with a second spring plate mounted within the lower magazine in a facing relationship relative to the first spring plate, with a coin of said coins arranged to be directed beyond the first guide spring plate and the second guide spring plate.

4. An apparatus as set forth in claim 3 wherein the piston rod includes a row of teeth directed into the housing, with a trigger lever pivotally mounted about a trigger lever axle within the housing, with the trigger lever projecting through the housing forward wall, and the trigger lever including a plurality of projections arranged to engage the teeth upon rotation of the trigger lever about the trigger lever axle to project the piston plate along the lower magazine.

5. An apparatus as set forth in claim 4 including a plurality of first guide pins orthogonally directed between the side walls, with the first guide pins positioned in adjacency to the top wall and the housing upper rear wall receiving the piston rod slidably therethrough, with a plurality of second guide pins mounted parallel to the first guide pins, with the second guide pins directed between the side walls in adjacency to the top wall and the guide tube.

6. An apparatus as set forth in claim 5 including a piston spring captured between the second guide pins and the piston plate.

* * * * *